United States Patent [19]

Debaigt

[11] 4,157,858

[45] Jun. 12, 1979

[54] DEVICE FOR FIXING A CASING ON A SECTION BAR WITH PARALLEL RIMS

[75] Inventor: Jean Debaigt, Maisons Laffitte, France

[73] Assignee: CGEE Alsthom, Levallois-Perret, France

[21] Appl. No.: 906,810

[22] Filed: May 17, 1978

[30] Foreign Application Priority Data

May 27, 1977 [FR] France ..... 77 16278

[51] Int. Cl.[2] ..... H01R 9/16

[52] U.S. Cl. ..... 339/198 GA

[58] Field of Search ..... 339/198 GA, 198 G, 198 R, 339/198 H; 174/158 R; 248/221.3, 223.2

[56] References Cited

U.S. PATENT DOCUMENTS 3,766,515 10/1973 Debaigt ..... 339/198 GA 3,970,276 7/1976 Debaigt ..... 339/198 GA 4,113,982 9/1978 Glaesel ..... 339/198 GA

*Primary Examiner*—Neil Abrams

*Assistant Examiner*—John S. Brown

*Attorney, Agent, or Firm*—Sughrue, Rothwell, Mion, Zinn and Macpeak

[57] ABSTRACT

The device is characterized in that the casing comprises at its base and on one side a bearing flat on one of the rims of a section bar, said flat being flanked firstly by a first resilient fixing tab which comprises at the level of the flat a resilient lock notch and secondly by a second fixing tab which comprises a rigid fixing notch at the level of the flat, the end of one of said rims co-operating with one of these notches, while on the other side of the casing the end of the other rim co-operates simultaneously but respectively with a rigid fixing notch disposed at the root of a third fixing tab and a resilient lock notch disposed at the end of said third resilient fixing tab.

6 Claims, 2 Drawing Figures

DEVICE FOR FIXING A CASING ON A SECTION BAR WITH PARALLEL RIMS

FIELD OF THE INVENTION

The invention relates to an arrangement for fixing a casing to a support comprising a section bar having parallel rims, and more particularly for fixing a casing constituted by a terminal block.

BACKGROUND OF THE INVENTION

Numerous devices have already been described for fixing a casing to a support bar having parallel rims in particular by means of resilient fixing tabs. Now, in an installation, circumstances sometimes lead to the use of several types of support bars; it is then desirable for the fixing arrangement of a single casing to be adaptable to several of these types of bar and more particularly to a bar having inwardly turned rims as well as to a bar having outwardly turned rims.

For this purpose, fixing arrangements have been contrived which comprise four fixing tabs, two of which are used for fixing to one type of bar and the other two of which are used for fixing to another type of bar. But such arrangements lead to fairly complex configurations and generally to fixing at different heights in relation to a reference edge of the support bar.

Preferred embodiments of the present invention enable a terminal block to be fixed to two different types of support bar (one having inwardly turned rims for engaging the block the other having outwardly turned rims) with the block extending to the same height from a reference rim in both cases.

The present invention provides a structural arrangement for fixing a casing to a support bar having parallel rims, said bar being one or other of two different types of bar, one type having rims turned outwards and the other type having rims turned inwards, the casing comprising a base having a flat at one side thereof which bears on one of the rims of a bar (of either type), said flat being flanked on its outer side by a first resilient fixing tab which includes a resilient lock notch at the level of the flat and on its inner side by a second fixing tab which includes a rigid fixing notch at the level of the flat, the end of said rim co-operating with one or other of these notches depending on the type of the bar, while on the other side of the casing, the end of the other rim co-operates simultaneously either with a rigid fixing notch disposed at the root of a third fixing tab or with a resilient lock notch disposed at the end of said third resilient tab.

Preferably, a recess is provided between the flat and the second fixing tab at the root of the fixing notch, the third fixing tab possibly including a vertical slot at its root.

The casing may include a second bearing flat at the level of the rigid fixing notch between the second fixing tab and the third fixing tab.

An embodiment of the invention is described by way of example with reference to the accompanying drawing.

DESCRIPTION OF THE PREFERRED EMBODIMENT

Figure 1:
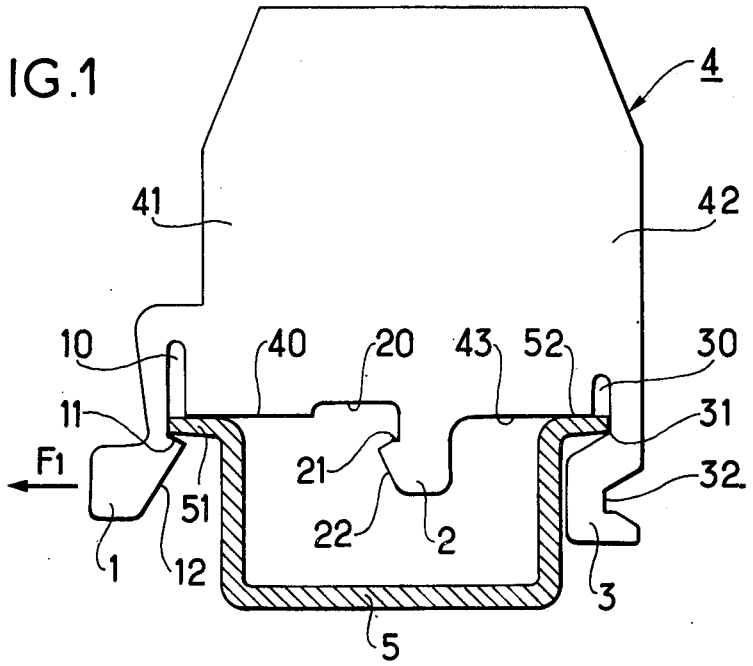
FIG. 1 is a diagrammatic view of a terminal block provided with a moulded fixing arrangement on a first support section bar.

The figures show a casing constituted by a terminal block 4 which has a left side 41 and a right side 42.

The block comprises at its base a fixing arrangement which includes a flat 40, a first fixing tab 1 disposed on the left side 41, a second fixing tab 2 disposed in the centre and a third fixing tab disposed on the right side 42.

The first fixing tab 1 is a resilient tab constituted by an extension of the left side 41 which is made resilient by a deep vertical slot 10 in a relatively resilient material. The fixing tab 1 comprises an engagement ramp 12 inclined towards the end of the tab 1, and a resilient fixing notch 11 facing the flat 40 and offset from the level thereof substantially by the thickness of a rim 51 of a support section bar 5.

The second fixing tab 2, which is rigid, likewise comprises a fixing notch 21 which leads to a recess 20 formed between the notch 21 and the flat 40 at the root of the tab 2 and an engagement ramp 22 inclined towards the end of the tab 2, facing the flat 40 and offset from the level thereof substantially by the thickness of a rim 51 of the support bar 5.

The third fixing tab 3 is constituted by an extension of the side 42 from a small vertical slot 30. This tab comprises a practically rigid fixing notch 31, facing the flat 43 and offset from the level thereof, substantially by the thickness of the rim 52 of the support bar 5. It also includes as its ends a lock notch 32 made resilient by the slot 30 and by the fact that it is distant from the root of the tab 2.

The flat 43 is disposed in the extension of the flat 40 between the tab 2 and the slot 30. The device operates as follows: the fixing of the terminal block on a support bar 5 which has parallel rims turned outwards is shown in FIG. 1. The end of the rim 52 is firstly engaged in the notch 31, then the end of the rim 51 is pressed against the engagement ramp 12, this causing the tab 1 to move away in the direction of the arrow $F_1$ until the rim 51 is applied against the flat 40. In this position the end of the rim 51 is locked in the resilient fixing notch 11 by resilient return of the tab 1 and the edge 52 is then also applied against the flat 43.

Figure 2:
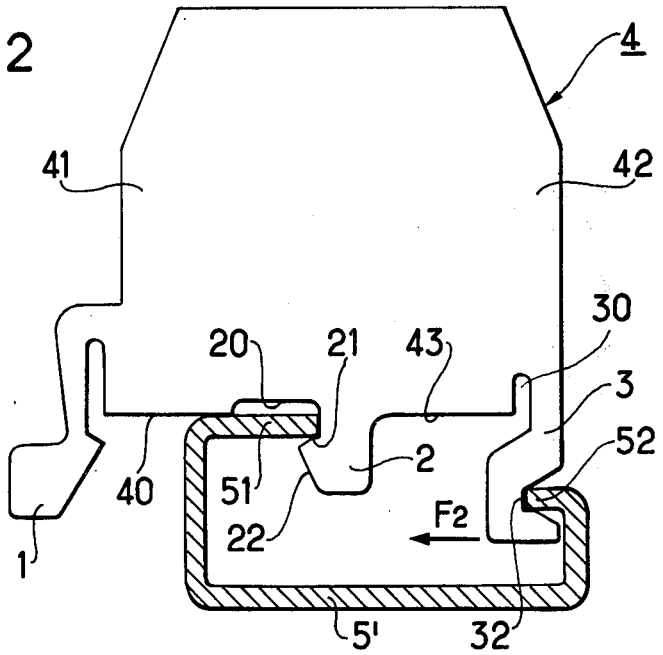
FIG. 2 is a diagrammatic view of the terminal block installed on a second support section bar.

The fixing of the terminal block on a support bar 5' which has parallel rims turned inwards is shown in FIG. 2. Firstly the end of the edge 52 is engaged against the resilient lock notch 32, then the end of the rim 51 is pressed against the inclined ramp 22 of the tab 2, this causing the resilient end of the tab 3 to move away in the direction of the arrow $F_2$ until the rim 51 is locked in the fixing notch 21 by resilient return of the tab 3.

With the two types of support bar the height of the terminal block is the same in relation to the reference of the rim 51 which is applied against the flat 40.

It is evident that the invention is in no way limited to the embodiment which has just been described and illustrated and which has been given only be way of an example; in particular, without going beyond the scope of the invention, some dispositions can be modified or some means can be replaced by equivalent means or even some components can be replaced by others which are capable of performing the same technical function or an equivalent technical function.

What is claimed is:

1. A structure for fixing a casing having opposite sides to a support bar having parallel rims, said bar being either of two different types, one type having rims turned outwards and the other type having rims turned inwards, said casing comprising a base having a flat which bears on one of the rims of either type bar, said flat being flanked on one outer side by a first resilient fixing tab which includes a first resilient lock notch at one side and at the level of the flat and on the inner side of said first tab by a second fixing tab which includes a second, rigid fixing notch at the level of the flat, said flat being flanked on the other outer side by a third resilient fixing tab having a rigid fixing notch disposed at the root of said third fixing tab and having a second resilient lock notch disposed at the end of said third resilient tab; whereby, the end of said rim at said one side co-operates with a given one of said notches depending on the type of bar, while on the other side of the casing, the other end of the other rim co-operates simultaneously with a rigid fixing notch disposed at the root of said third fixing tab or with said second resilient lock notch disposed at the end of said third resilient tab, depending upon the type of bar.

2. A structure according to claim 1, including a recess provided between the flat and the second fixing tab at the root of the fixing notch.

3. A structure according to claim 1, wherein the first tab is formed by an extension of the side of the casing from which it is separated by a slot.

4. A structure according to claim 1, wherein the third fixing tab includes, at its root, a small vertical slot.

5. A structure according to claim 1, wherein the casing includes a second bearing flat at the level of the rigid fixing notch between the second fixing tab and the third fixing tab.

6. A structure according to claim 1, wherein the casing is a terminal block.

* * * * *